US005161507A

United States Patent [19]

Terazawa et al.

[11] Patent Number: 5,161,507

[45] Date of Patent: Nov. 10, 1992

[54] THROTTLE CONTROL APPARATUS

[75] Inventors: Tadashi Terazawa, Toyota; Tatsuo Kato, Handa; Mitsuo Kikkawa, Anjo; Shoichi Doi, Kariya, all of Japan

[73] Assignee: Aisin Seiki Kabushiki Kaisha, Kariya, Japan

[21] Appl. No.: 809,321

[22] Filed: Dec. 18, 1991

[30] Foreign Application Priority Data

Dec. 26, 1990 [JP] Japan ..... 2-416884

[51] Int. Cl.[5] ..... F02D 7/00

[52] U.S. Cl. ..... 123/399; 123/400

[58] Field of Search ..... 123/399, 400, 401, 396, 123/361, 403, 367

[56] References Cited

U.S. PATENT DOCUMENTS

| | | | |
|---|---|---|---|
| 4,798,258 | 1/1989 | Oddeson | 123/401 |
| 5,016,589 | 5/1991 | Tarazawa et al. | 123/399 |
| 5.040,508 | 8/1991 | Watanabe | 123/396 |
| 5,048,485 | 9/1991 | Tarazawa et al. | 123/400 |

FOREIGN PATENT DOCUMENTS

| | | | |
|---|---|---|---|
| 55-145867 | 11/1980 | Japan | 123/399 |
| 59-153945 | 9/1984 | Japan | 123/399 |
| 63-80039 | 4/1988 | Japan | 123/399 |
| 2-204641 | 8/1990 | Japan | 123/399 |

*Primary Examiner*—Raymond A. Nelli

*Attorney, Agent, or Firm*—Burns, Doane, Swecker & Mathis

[57] ABSTRACT

A throttle control apparatus includes an accelerator operation mechanism, a driving source, a throttle shaft fixing a throttle valve, a supporting member fixed to the throttle shaft, a rotor supported on the throttle shaft and connected with the driving source so as to be rotated by the driving source, a movable member movably supported on the throttle shaft in the axial direction of the throttle shaft between the rotor and the supporting member, a connection member connecting the movable member with the supporting member, an electromagnetic coil attracting the movable member under the exciting condition for connecting the movable member with the rotor, an engaging member fixed to the movable member and extending toward the axial direction of the throttle shaft, an operation member having an end surface which can be engaged with the engaging member and connected with the accelerator operation mechanism so as to be able to rotate in response to the accelerator. The throttle control apparatus is constituted so as not to engage the engaging member with the operation member under the exciting condition of the electromagnetic coil. Therefore, in the acceleration slip control, the driving source is controlled in response to the slip condition and throttle shaft is rotated by the driving source regardless of the accelerator. The engagement between the rotor and the movable member is released under the abnormal condition and the engaging member is engaged with the operation member. Thereby, the throttle shaft is directly driven in response to the operation of the accelerator.

3 Claims, 6 Drawing Sheets

THROTTLE CONTROL APPARATUS

BACKGROUND OF THE INVENTION

1. Field of the Invention

The present invention relates to a throttle control apparatus installed on an internal combustion engine, and more particularly to a throttle control apparatus for controlling the opening and closing action of a throttle valve by a driving source such as a motor and so on in response to an operation of an accelerator and for being able to perform various controls such as an acceleration slip control, a constant speed driving control and so on.

2. Description of the Prior Art

In an internal combustion engine which is provided with a carburetor, a throttle valve controls a mixed gas which air and fuel are mixed each other and in an internal combustion engine which is provided with an electronic controlled fuel injection apparatus, a throttle valve controls the generating power of the internal combustion engine by adjusting the intake air flow. These throttle valves are constituted so as to link with an accelerator operation mechanism including an accelerator.

In recent years, apparatuses each of which is set to open and close the throttle valve by a driving source such as a motor and so on in response to an operation of an accelerator are proposed in contrast to the above prior art in which the accelerator operation mechanism is mechanically connected with the throttle valve. An apparatus which drives a stepping motor connected with the throttle valve in response to an operation of an accelerator is disclosed, for example, in Japanese patent application laid-open publication No. 55(1980)-145867.

On the contrary, a prior measure example against the condition under which the control of an electronic controlled actuator for driving the above stepping motor is impracticable is enumerated in Japanese patent application laid-open publication No. 59(1984)-153945. For example, a throttle shaft is set to be separated from the electronic actuator by an electromagnetic clutch for closing the throttle valve by a return spring. In this prior art, however, there is not a drive means which opens-closes the throttle valve after the malfunction of control of the electronic controlled actuator and therefore there is a drawback that the vehicle can't be transfered to the suitable place for repairing. Therefore, an apparatus which overcomes the above drawback is disclosed in Japanese patent application laid-open publication No. 59(1984)-153945.

Namely, this apparatus includes an electromagnetic clutch interposed between the throttle shaft and a rotating shaft rotated by a depression of the accelerator and arranged so as to separate both shafts from each other in its exciting condition and to connect both shafts each other in its nonexciting condition and a control circuit for detecting abnormalities of operations of the electronic controlled actuator and for stopping the supply of an electric source to the electronic controlled actuator and the electromagnetic clutch by a relay. In this apparatus, the throttle shaft is mechanically connected with the accelerator via the electromagnetic clutch when the control of the electronic controlled actuator became impracticable.

Furthermore, an apparatus which overcomes the foregoing drawback of the prior apparatus disclosed in the above latter publication is disclosed in Japanese patent application laid-open publication No. 63(1988)-80039. In this apparatus, the accelerator operating portion and the throttle valve are connected each other when the amount of the throttle valve opening corresponded to the operational amount of the accelerator operating portion under the abnormal condition of the actuator and so on in contrast to the above prior apparatus which the amount of the throttle valve opening does not correspond to the operational amount of the accelerator operating portion when the accelerator operating portion and the throttle valve were connected each other. According to this apparatus, the electric current is not turned on an electromagnetic coil under the normal condition and is turned on the electromagnetic coil under the abnormal condition so as to connect the throttle valve with an accelerator link each other. And then the electric current which is turned on the electromagnetic coil is interrupted temporarily when the accelerator is released in the abnormal condition and thereby the connection between the accelerator link and a clutch disk is released. After the throttle valve has been fully closed the electromagnetic coil is excited again and thereby the accelerator link and the clutch disk are connected each other.

On the contrary, a throttle control apparatus which can maintain a predetermined amount of the throttle valve opening under the abnormal or an unexpected condition of the driving source is disclosed in Japanese patent application laid-open publication No. 2(1990)-204641. In this apparatus, namely, a connection of a clutch means between a throttle open-close means and a second driving means which is linked to the driving source is interrupted when the driving souce abnormally operated. Then, when the accelerator operation mechanism is operated more than a predetermined operation amount, the throttle open-close means is drived via a first driving means and thereby the predetermined amount of the throttle valve opening is maintained.

In the apparatus which is disclosed in the above Japanese patent application laid-open publication No.59(1984)-153945, a condition under which the control of the electronic controlled actuator becomes impracticable is detected by the additional control circuit. This control circuit stops the supplying of the electric to the electronic controlled actuator and the electromagnetic clutch. Then, the throttle shaft and the rotating shaft which is mechanically connected with the accelerator are connected with each other by the electromagnetic clutch after the control of the electronic controlled actuator is stopped. Now, even though the throttle valve is directly driven by the operation of the accelerator, the throttle valve maintains a condition which is connected with the actuator. In this situation, since the driving torque is not generated in the motor under the condition that the control of the electronic controlled actuator stops, the open-close operation of the throttle valve is obtained without hindrance in response to the operation of the accelerator.

Accordingly, the electromagnetic clutch which is used in such prior apparatus becomes large in structure and increases the cost too. Furthermore, it is necessary to take a measure so that the throttle valve is prevented from being driven continually toward the opening position by the abnormal operation of the electronic controlled actuator and so on. In the apparatus which is disclosed in the above Japanese patent application laid-open publication No.63(1988)-80039, since the electric current is set to turn on the electromagnetic coil under the abnormal condition of the actuator and so on and therefore the throttle valve is connected with the acclerator operation portion, it is not able to drive thr throttle valve by the accelerator operation when an abnormality which the electric current is not turned on the electromagnetic coil and therefore, for example, it is not able to drive the vehicle to the repair place.

On the contrary, in the apparatus which is disclosed in the above Japanese patent application laid-open publication No.2(1990)-204641, since the accelerator operation mechanism is mechanically connected with the throttle open-close means by depressing the accelerator more than the predetermined amount when an electromagnetic clutch mechanism of the clutch means becomes a condition which the electric current is not turned on and it is able to maintain the predetermined amount of the throttle valve opening, the above drawback is not caused.

Now, what is called 'a traction control' is well known as a control method for preventing slips of driving wheels at a starting time or an accelerating time, namely acceleration slips. When the accelerator is carelessly depressed on snow-covered road or iced road and so on, the driving wheels slip and therefore an insufficient acceleration or a side slip are caused. According to the traction control, it is able to prevent the generation of these phenomenons. In the traction control, in general, the throttle valve of the combustion engine is driven toward closing position regardless of the operation of the accelerator by driver or a braking force is moderately applied to the drving wheels, and thereby each slip ratio of the driving wheels is controlled in a proper range.

The traction control is performed by the apparatus which is disclosed in the above Japanese patent application laid-open publication No.2(1990)-204641 too. In this apparatus, however, when the driver depresses the accelerator more than the predetermined amount while the traction control is performed, the throttle valve is opened and the predetermined amount of the throttle valve opening is obtained. Accordingly, for example, when it is required to fully close the throttle valve in the traction control, it is not able to perform the expected acceleration slip control.

SUMMARY OF THE INVENTION

It is, therefore, an object of the present invention to provide an improved throttle control apparatus which overcomes drawbacks of the above prior arts.

It is another object of the present invention to provide an improved throttle control apparatus which performs the accelerator slip control by the driving source such as the electronic controlled actuator regardless of the operation of the accelerator and which can open-close the throttle valve by the operation of the accelerator directly after the connection between the driving source and the throttle shaft is released when the abnormality is generated in the driving source and so on.

In order to achieve these objects, there is provided an improved throttle control apparatus includes an accelerator operation mechanism, a driving source generating driving force in response to at least an operational amount of the accelerator operation mechanism, a throttle shaft fixing a throttle valve of an internal combustion engine thereto and supported on a housing so as to be able to rotate and having at least an one end portion which extends from the housing, a supporting member fixed to an extending portion of the throttle shaft, a rotor supported at a prescribed position on the throttle shaft between the supporting member and the housing so as to be able to rotate and so as not to be able to move in the direction of an axis of the throttle shaft and connected with the driving source so as to be rotated by the driving force of the driving source, a movable member made of a magnetic substance and supported on the throttle shaft so as to be movable in the direction of the axis of the throttle shaft between the rotor and the supporting member, a connection member connecting the movable member with the supporting member and urging the movable member toward the supporting member, an electromagnetic coil fixed at a position of the housing opposite to the rotor and attracting the movable member under its own exciting condition so as to connect the movable member with the rotor, an engaging member fixed to the movable member at its one end and extending its other end in the axial direction of the throttle shaft, an operation member supported on a shaft which is disposed nearly in parallel with the axis of the throttle shaft so as to be able to rotate and having an end surface which can be engaged with the other end of the engaging member in nearly perpendicular direction with regard to the axis of the throttle shaft and connected with the accelerator operation mechanism so as to be able to rotate in response to the operation of the accelerator operation mechanism and the engaging member having longitudinal length which can be engaged with the end surface of the operation member only when the movable member positions at the side of the supporting member.

BRIEF DESCRIPTION OF THE DRAWINGS

Additional objects and advantages of the present invention will become more apparent from the following detailed description of preferred embodiment thereof when considered with reference to the attached drawings, in which.

DESCRIPTION OF THE PREFERRED EMBODIMENTS

A throttle control apparatus which is constituted in accordance with a preferred embodiment of the present invention will be described with reference to the drawings.

Figure 1:
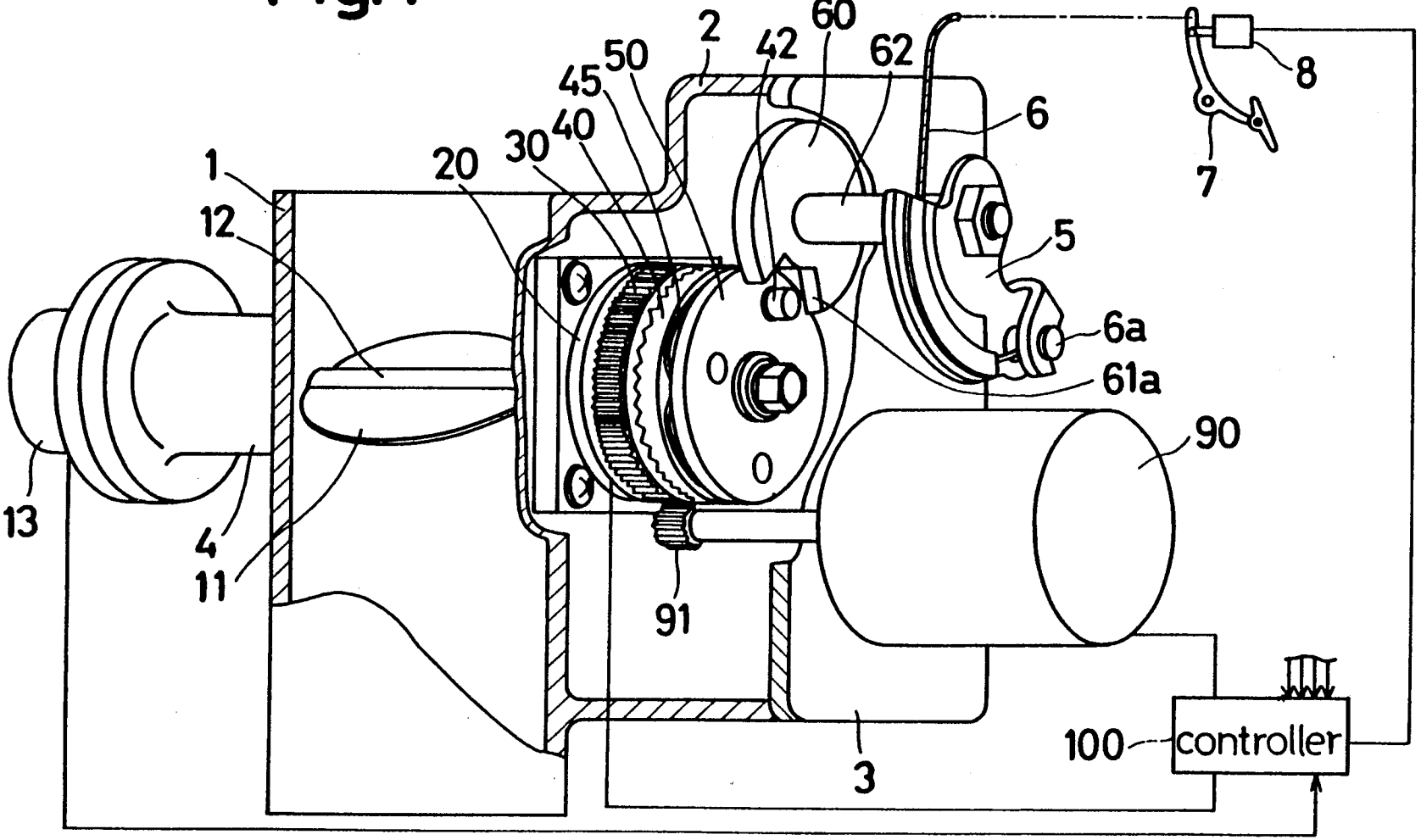
FIG. 1 is a perspective view of an embodiment of a throttle control apparatus in accordance with the present invention.
Figure 2:
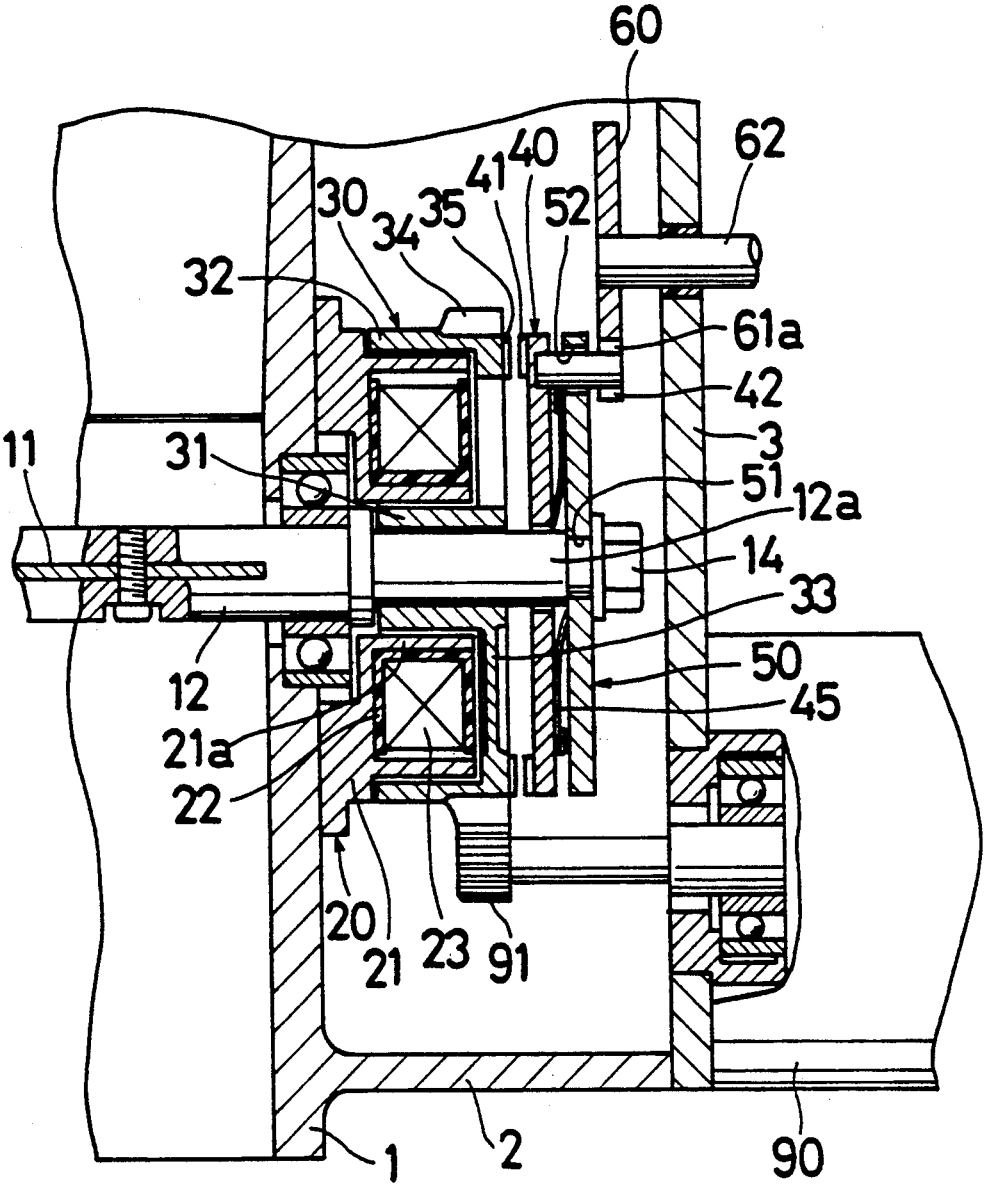
FIG. 2 is a longitudinal sectional view of an embodiment of a throttle control apparatus in accordance with the present invention.
Figure 3:
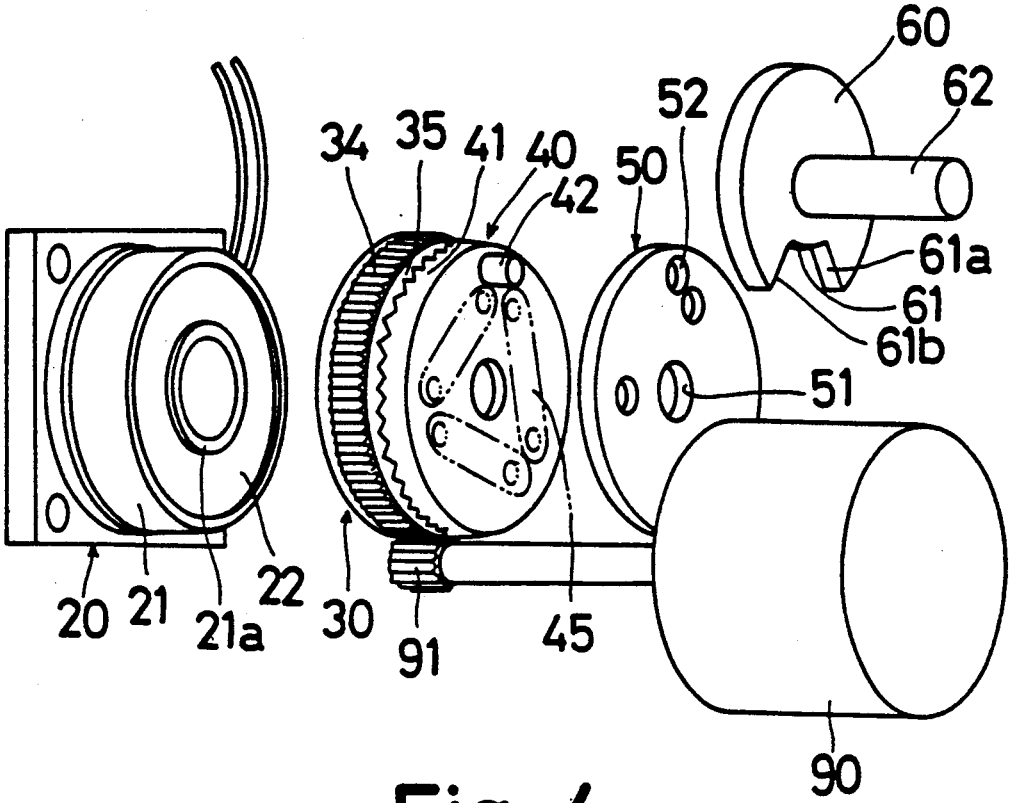
FIG. 3 is an exploded perspective view of an embodiment of a throttle control apparatus in accordance with the present invention.

Referring to FIG. 1 to FIG. 3, a throttle valve 11 is disposed in a housing 1 which forms an intake air passage of an internal combustion engine. The throttle valve 11 is fixed to a throttle shaft 12 and the throttle shaft 12 is supported on the housing 1 so as to be able to rotate. One end of the throttle shaft 12 extends from a side of the housing 1 to the outside. At the side of the housing 1 which locates around an extending portion 12*a*, a case 2 is formed in a body and a cover 3 is united with the case 2. The principal part of parts constituting the throttle control apparatus of this embodiment is received in a space which is defined by the case 2 and the cover 3. On the other hand, at a side of the housing 1 which locates opposite to the case 2 and on which the other end of the throttle shaft 12 is supported, a cylindrical support 4 is formed on the housing 1 in a body. In the support 4, a return spring (not shown) is received and thereby the throttle shaft 12 is urged by the return spring so as to fully close the throttle valve 11.

At the other end of the throttle shaft 12, a throttle sensor 13 is connected therewith. Since this throttle sensor 13 transforms rotational displacements into electric signals and the structure is well known, the explanation of the structure is omitted. This throttle sensor 13 supplies, for example, an idle-switch signal showing the fully closed position of the throttle valve 11 and a throttle valve opening amount signal corresponding to the amount of the throttle valve 11 opening to a controller 100 as outputs.

An electromagnetic coil 20 is fixed to the side of the housing 1 so as to surround a base portion of the extending portion 12*a* of the throttle shaft 12. The electromagnetic coil 20 is provided with a yoke 21 which is made of a magnetic substance and a bobbin 22 which is made of resin as shown in FIG. 2 and FIG. 3. The yoke 21 is provided with a cylindrical portion 21*a* at its center. Around this cylindrical portion 21*a*, a circular portion is formed on the yoke 21 and the bobbin 22 and a coil 23 are disposed in the circular portion. A bottom portion of the yoke 21 is fixed to the side of the housing 1 and the extending portion 12*a* of the throttle shaft 12 penetrates into the cylindrical portion 21*a*.

Figure 4:
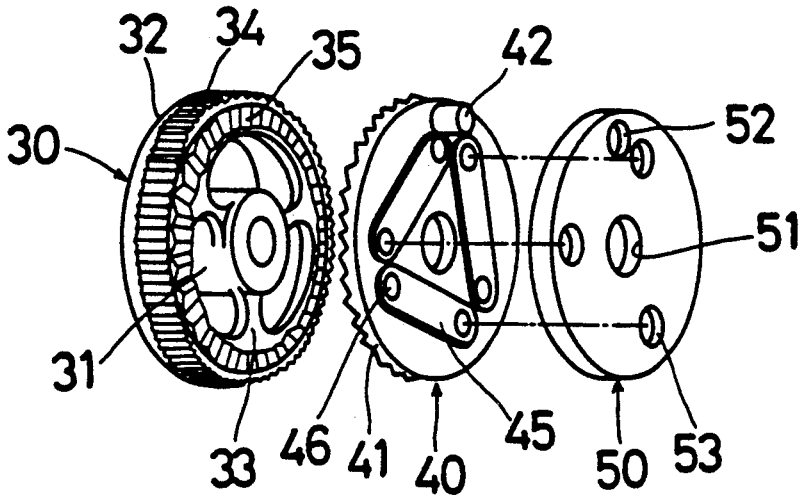
FIG. 4 is an exploded perspective view of an electromagnetic clutch mechanism of an embodiment of a throttle control apparatus in accordance with the present invention.

Furthermore, a rotor 30 which is made of a magnetic substance is supported on the extending portion 12*a* of the throttle shaft 12 so as to be able to rotate. The rotor 30 is disposed in a prescribed position which is opposite to the yoke 21 and is held so as not to be able to move in the direction of an axis of the throttle shaft 12. As shown in FIG. 2 and FIG. 4, the rotor 30 is made of a sintered metal using mainly iron and has a shape which a cylindrical portion 32 is connected with an axial portion 31 supported on the throttle shaft 12 via arm portions 33. The axial portion 31 of the rotor 30 is fitted into the cylindrical portion 21*a* of the yoke 21 with a predetermined gap so as to overlap in the axial direction and the cylindrical portion 32 of the rotor 30 surrounds the outer side of the yoke 21. Thereby, a magnetic loss which generates in gaps between the yoke 21 and the rotor 30 is restrained and a predetermined magnetic permeance is maintained.

At an outer circumferential side of the cylindrical portion 32 of the rotor 30, outer teeth 34 are formed in a body. Furthermore, at a flat portion adjacent to the outer tooth 34, as shown in FIG. 3 and FIG. 4, first nail portions 35 which have triangular sectional shape are continuously arranged on the whole circumference so as to radially extend and are wavily formed thereon.

Furthermore, a clutch plate 40 which has a disk-shape is supported on the throttle shaft 12 so as to confront with the rotor 30. The clutch plate 40 corresponds to a movable member of the present invention and is able to move in the axial direction. The clutch plate 40 is made of a magnetic substance and is provided with second nail portions 41 which have a same triangular sectional shape as the first nail portions 35 and which are formed on the whole circumference of an its own flat portion opposite to the first nail portions 35 so as to radially extend like the first nail portions 35. Now, this second nail portions 41 can be formed by not only machining or electrospark machining but also can be formed by press.

A pin 42 is fixed to a face of the clutch plate 40 which locates opposite the face having the second nail portions 41. Now, the pin 41 corresponds to an engaging member of the present invention. Furthermore, at this face of the clutch plate 40, one ends of the sheet springs 45 which are shown by a chain line in FIG. 3 and which are shown by a solid line in FIG. 4 are fixed thereto by pins 46. On the other hand, the other ends of the sheet springs 45 are fixed to a plate holder 50 mentioned later by pins (not shown). Accordingly, the clutch plate 40 is connected with the plate holder 50 via the sheet springs 45. Now, if one of the pins 46 for fixing the sheet springs 45 is extended and is used as the pin 42 in common, it is able to reduce the number of the parts. Now, the sheet springs 45 correspond to the connection member of the present invention.

At a top end portion of the extending portion 12*a* of the throttle shaft 12, the plate holder 50 is fixed thereto. Now, the plate holder 50 corresponds to the supporting member of the present invention. The plate holder 50 is provided with an oval hole 51 which is formed at its center. On the other hand, the top end portion of the extending portion 12*a* of the throttle shaft 12 is formed so as to be same sectional shape as the hole 51 and is fitted into the hole 51. Thereby, the plate holder 50 is restrained from rotating with regard to the throttle shaft 12. The top end portion of the extending portion 12*a* has a same length as thickness of the plate holder 50. A bolt (or a nut) 14 is screwed down the top end surface of the extending portion 12*a* and thereby the plate holder 50 is nipped between the bolt (or the nut) 14 and a step portion which is formed at a base portion of the top end portion of the extending portion 12*a*. Now, the hole 51 and the top end portion of the extending portion 12*a* may have, for example, a semicircular sectional shape and can be formed various shapes which restrain the plate holder 51 for rotating with regard to the throttle shaft 12.

The plate holder 50 is further provided with a hole 52 and holes 53. The hole 52 is formed at outer edge portion of the plate holder 50 and the pin 42 is penetrated into the hole 52. The holes 53 are formed for caulking the sheet springs 45. Thus, when the plate holder 50 is fixed on the throttle shaft 12, a top end of the pin 42 is projected from the hole 52 of the plate holder 50 as shown in FIG. 1 and FIG. 2.

Furthermore, an operation plate 60 is disposed around the pin 42 which is fixed to the clutch plate 40 so as to be opposite to the plate holder 50 at its outer edge portion. Now, the operation plate 60 corresponds to an operation member of the present invention. An accelerator shaft 62 is fixed to a center portion of the operation plate 60 and is supported by the cover 3 in nearly parallel with the throttle shaft 12 so as to be able to rotate. Now, the operation plate 60 is restrained from moving in the axial direction. The operation plate 60 is provided with a notch 61 which is formed at its outer edge portion so as to overlap with the pin 42. The operation plate 60 is arranged so that at least one of radial surfaces 61*a* and 61*b* can contact with side of the pin 42 in response to the rotation of the operation plate 60 in the nonexciting condition of the electromagnetic coil 20.

Other end of the accelerator shaft 62 is connected with an accelerator plate 5 shown in FIG. 1 by a bolt or a nut and a cable end 6*a* which is formed on one end of an accelerator cable 6 is engaged with an outer edge portion of the accelerator plate 5. The other end of the accelerator cable 6 is connected with an accelerator 7 and thereby an accelerator operation mechanism by which the operation plate 60 is rotated around an axial center of the accelerator shaft 62 in response to the operation of the accelerator 7 is constituted. A well-known accelerator sensor 8 is installed on the accelerator 7. Thereby, an operation amount of the accelerator 7 is detected by the accelerator sensor 8 and an electric signal corresponding the operation amount is supplied to the controller 100. Now, the accelerator sensor 8 may be arranged so as to link to the accelerator shaft 62.

Furthermore, a motor 90 as a driving source of the present invention is fixed to the cover 3 and a rotation shaft of the motor 90 is supported in parallel with the throttle shaft 12 so as to be able to rotate. At a top end of the rotation shaft of the motor 90, a pinion gear 91 is fixed thereto and is engaged with the outer teeth 34 of the rotor 30. In this embodiment, a stepping motor is employed as the motor 90 and is driven and controlled by the controller 100. Now, it is able to apply a motor of other-type, for example, such as DC motor as the motor 90.

When the motor 90 is driven and the pinion gear 91 is rotated, the rotor 30 having the outer teeth 34 which are engaged with the pinion gear 91 is rotated around the throttle shaft 12. In this situation, if the electromagnetic coil 20 is in its nonexciting condition, the clutch plate 40 is separated from the rotor 30 by the urging force of the sheet springs 45 and is located in the adjacent position to the plate holder 50. Namly, the clutch plate 40, the plate holder 50 and the throttle valve 11 can be freely rotated by the throttle shaft 12 regardless of the condition of the rotor 30. In this situation, the pin 42 which is fixed to the clutch plate 40 is located between both surfaces 61*a* and 61*b* of the notch 61 of the operation plate 60.

Figure 5:
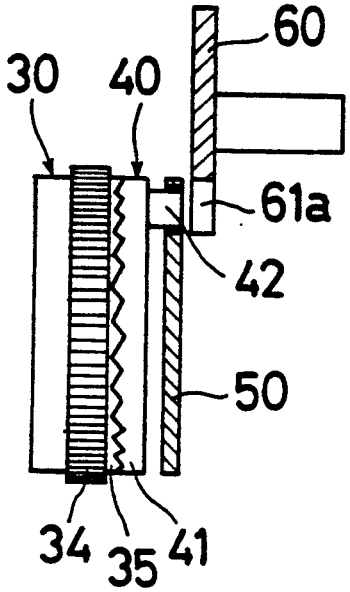
FIG. 5 is a partially sectional side view of a condition which a clutch plate is connected with a rotor of an embodiment of a throttle control apparatus in accordance with the present invention.
Figure 6:
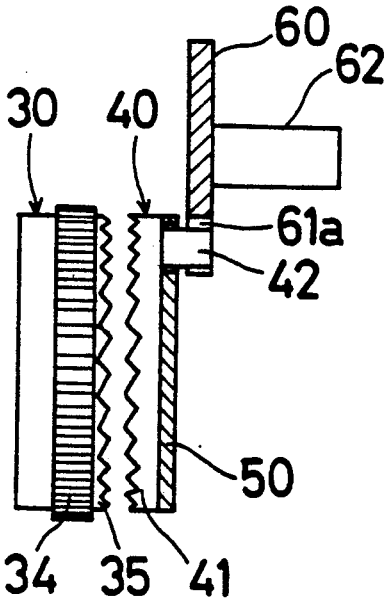
FIG. 6 is a partially sectional side view of a condition which a clutch plate is separated from a rotor of an embodiment of a throttle control apparatus in accordance with the present invention.

When the electromagnetic coil 20 is excited, a closed magnetic circuit is formed by the yoke 21, the rotor 30 and the clutch plate 40. Thereby, the clutch plate 40 is attracted toward the rotor 30 against to the urging force of the sheet springs 45 by an electromagnetic force and the first nail portions 35 of the rotor 30 and the second nail portions 41 of the clutch plate 40 are engaged with each other. Namely, as shown in FIG. 5, the rotor 30 and the clutch plate 40 become an engaging condition and become a condition which are able to rotate in a body. Thereby, driving controlled variable of the motor 90 is transmitted from the pinion gear 91 to the rotor 30 via the outer teeth 34 and next is transmitted to the clutch plate 40 via the first nail portions 35 and the second nail portions 41. Furthermore, the driving controlled variable is transmitted from the clutch plate 40 to the plate holder 50 via the sheet springs 45 and therefore is transmitted to the throttlle shaft 12 which rotates with the plate holder 50 in a body. As a result, the amount of the throttle valve 11 opening is controlled in response to the above driving controlled variable. In this situation, since the pin 42 moves with the clutch plate 40 toward the rotor 30 and does not locate between both surfaces 61*a* and 61*b* of the notch 61 of the operation plate 60, the operation plate 60 is rotated regardless of the condition of the pin 42.

When the electric current being supplied to the electromagnetic coil 20 is interrupted under the opening condition of the throttle valve 11, the engagement between the first nail portions 35 of the rotor 30 and the second nail portions 41 of the clutch plate 40 is released and then the throttle valve 11 is fully closed by the urging force of the return spring (not shown) which is disposed in the support 4. Then, the pin 42 is located between both surfaces 61*a* and 61*b* of the notch 61 of the operation plate 60. Therefore, when the operation plate 60 is operated and is rotated, the surface 61*a* is cotacted with the side of the pin 42 and the clutch plate 40 and the plate holder 50 are rotated.

Figure 7:
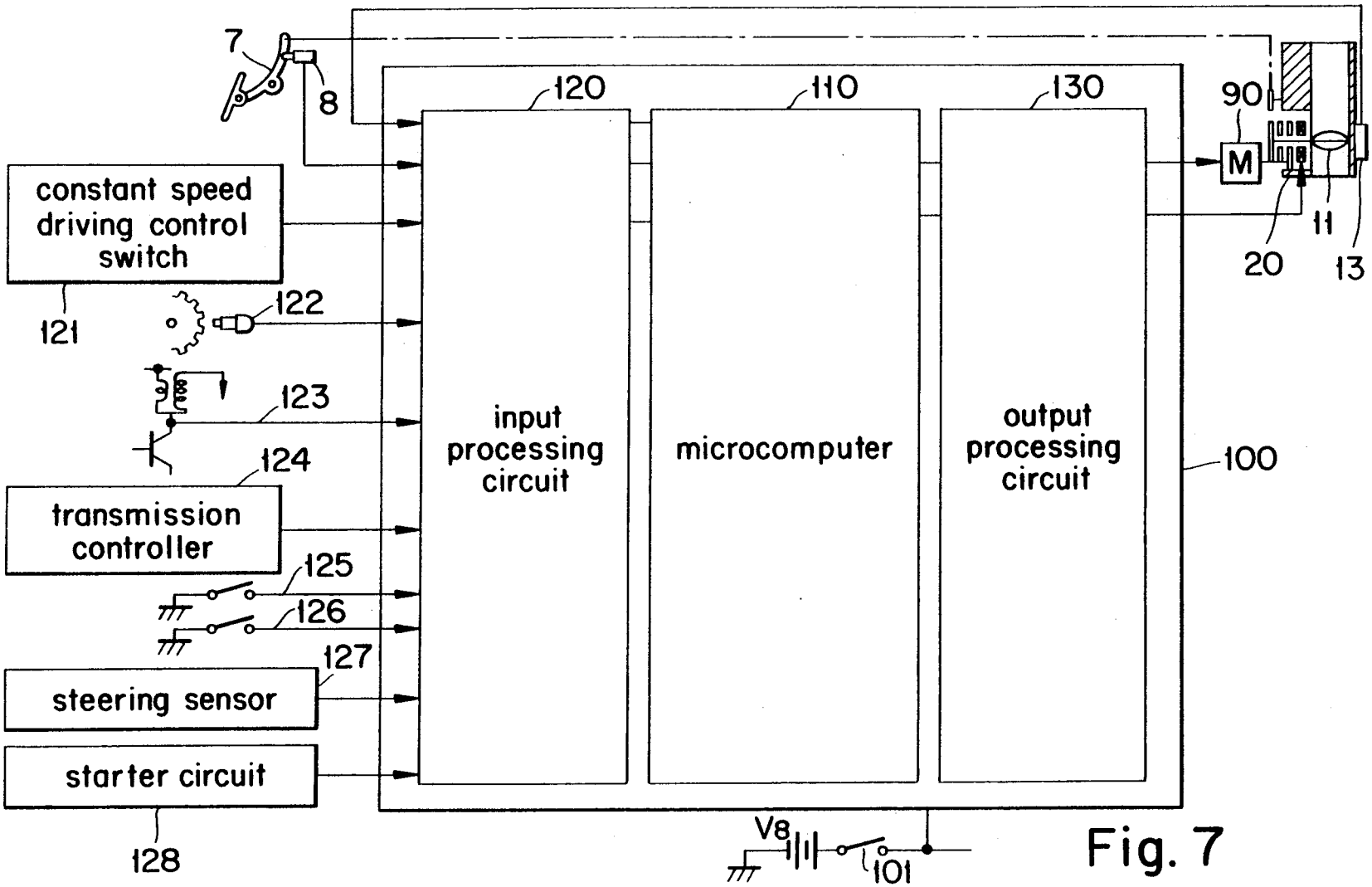
FIG. 7 is a schematic illustration of a controller and an input and output device of an embodiment of a throttle control apparatus in accordance with the present invention; and, FIG. 8 is a flow-chart which shows a general operation of an embodiment of a throttle control apparatus in accordance with the present invention.

The controller 100 is a control circuit including microcomputer. The controller 100 is installed on the vehicle and is supplied detecting signals of various sensors as shown in FIG. 7. Thereby, various controls including the driving controls of the electromagnetic coil 20 and the motor 90 are performed by the controller 100. In this embodiment, the various controls such as a constant speed driving control, an acceleration slip control and so on are performed besides an ordinary control responding to the operation of the accelerator by the controller 100.

Referring to FIG. 7, the controller 100 is provided with a microcomputer 110, an input processing circuit 120 and an output processing circuit 130. The input processing circuit 120 and the output circuit 130 are connected with the microcomputer 110 and the motor 90 and the electromagnetic coil 20 are connected with the output processing circuit 130. Furthermore, the controller 100 is connected with an electric source $V_B$ via an ignition switch 101. Now, it is able to apply a transistor or a relay which turns on electricity when the ignition switch 101 is ON or other switching elements as an electric source opening-closing means of the controller 100.

Furthermore, the accelerator sensor 8 is connected with the input processing circuit 120. A signal which is generated by the accelerator sensor 8 in response to the depressing amount of the accelerator 7 is supplied to the output processing circuit 120 with an output signal of the throttle sensor 13. The electromagnetic coil 20 is controlled by the controller 100 so as to excite and nonexcite in response to the driving condition of the vehicle and furthermore the driving of the motor 90 is controlled by the controller 100 so as to be able to obtain the amount of the throttle valve 12 opening which is determined in response to depressing amount of the accelerator 7 and various control conditions. A constant speed driving control switch 121 which is constituted by plural groups of switches (not shown) is connected with the input processing circuit 120.

A wheel speed sensor 122 is used for the constant speed driving control, the acceleration slip control and so on and an electromagnetic pickup sensor or hole sensor and son are applied as the wheel speed sensor 122. Now, one wheel speed sensor 122 is shown in FIG. 7, but the wheel speed sensor 122 is installed on each wheel according to demand. Furthermore, an ignition circuit unit, commonly called an igniter 123 is connected with the controller 100. Thereby, an ignition signal is supplied from the igniter 123 to the controller 100 and the number of rotations of the combustion engine is detected. A transmission controller 124 is a control device for controlling an automatic transmission and a variable speed signal and a timing signal which are generated in the transmission controller 124 are supplied to the controller 100.

Furthermore, a mode changeover switch 125, an acceleration prohibition switch 126 and a steering sensor 127 are connected with the input processing circuit 120. The mode changeover switch 125 selects one of maps which predetermined about relationships between the depressing amount of the accelerator 7 and the amount of the throttle valve 12 opening in response to various driving modes and determines the amount of the throttle valve 12 opening in response to the selected driving mode. Now, the maps are memorized in the microcomputer 110. Thereby, for example, a power mode or an economy mode, in other words, a highway driving mode or a city area driving mode is selectively determined as the driving mode. The acceleration slip control prohibition switch 126 supplies a signal for prohibiting the acceleration slip control to the microcomputer 110 when a driver does not require the acceleration slip control and operates that. The steering sensor 127 judges whether a steering (not shown) is operated or not for example when the acceleration slip control is performed and determines a target slip rate in response to the result of the judgement. Furthermore, a starter circuit 128 which controls the driving of a starting motor (not shown) is connected with the input processing circuit 120. Thereby, the starting motor is not driven until the normal functioning of the throttle control apparatus is confirmed by the practical open-close operation of the throttle valve 12 when an initial check is performed whether the throttle control apparatus functions normally or not. Therefore, it is able to avoid the excess rotation of the combustion engine when the initial check of the throttle control apparatus is performed.

Figure 8:
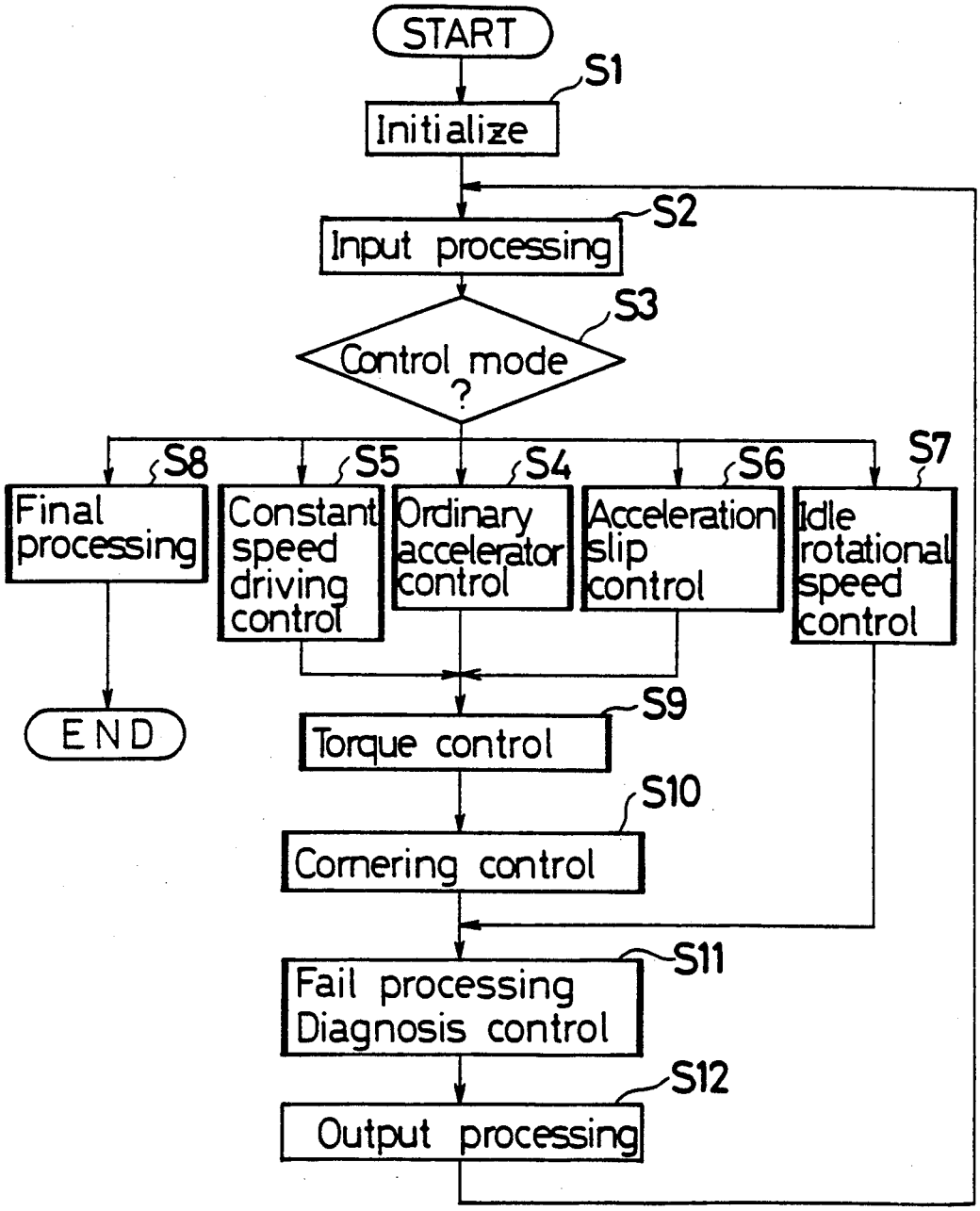

The above-described embodiment of the throttle control apparatus operates as follows. FIG. 8 is a flowchart which shows a general operation of this embodiment of a throttle control apparatus. In the controller 100, at first, an initialize is performed in step S1 and next the above-described various input signals which are supplied to the input processing circuit 120 are processed in step S2. Next, step 3 is performed and a control mode is selected in response to the input signals. Namely, one of steps S4–S8 is selected.

When the controls of the steps S4–S6 are performed (now, the ordinary accelerator control is performed in step S4, the constant speed driving control is performed in step S5 and the acceleration slip control is performed in step S6), a torque control and a cornering control are performed in step S9 and step S10, respectively. In the torque control, the throttle control is performed so as to reduce a shock which is generated in a variable speed operation. On the other hand, in the cornering control, the throttle control is performed in response to a steering angle of the steering (not shown). Now, since both controls are not directly related to this embodiment, explanation are omitted. Step S4 performs an idle rotational speed control and controls the throttle control apparatus so as to maintain the idle rotational speed even though the condition of the internal combustion engine changes. Step S8 performs an after-process after the ignition switch 101 became OFF. After the steps S7 and S10 were performed, respectively, a self-diagnosis is performed in step S11 by a diagnosis means and furthermore a fail-process is performed in step S11. Next, an output-process is performed in step S12 and the electromagnetic coil 20 and the motor 90 are driven via the output processing circuit 130. Thereafter, the above-described routine is repeated with a predetermined period.

Next, the operation of the ordinary accelerator control mode in the above general operation is explained. When the accelerator 7 is not operated, namely when the throttle valve 11 is fully closed, the clutch plate 40 is located at the side of the plate holder 50 by the urging force of the sheet springs 45 and is separated from the rotor 30.

When the electromagnetic coil 20 is applied an electric current and the yoke 21 and the rotor 30 are excited, the clutch plate 40 is attracted toward the rotor 30 and the first nail portions 35 and the second nail portions 41 are engaged with each other. A condition which is able to transmit the driving force of the motor 90 to the throttle shaft 12 is obtained. In this situation, since the pin 42 is moved with the clutch plate 40 toward the rotor 30, the notch 61 of the operation plate 60 is not engaged with the pin 42. Hereafter, except for abnormal conditions mentioned later, the throttle shaft 12 is rotated by the motor 90 and thereby the amount of the throttle valve 11 opening is controlled by the control of the motor 90 in the controller 100.

In the ordinary accelerator control mode, namely, when the depressing operation of the accelerator 7 is performed, an output signal of the accelerator sensor 8 is supplied to the controller 100 in response to the operation amount and a target amount of the throttle valve opening is determined in the controller 100. Then, when the motor 90 is driven and the throttle shaft 12 is rotated, an output signal of the throttle sensor 13 is supplied to the controller 100 in response to the rotational angle of the throttle shaft 12 and the driving of the motor 90 is controlled by the controller 100 so as to nearly equalize the amount of the throttle valve 11 opening to the above target amount of the throttle valve opening. Thereby, the throttle control corresponding to the operation amount of the accelerator 7 is performed and the generating power of the engine which corresponds to the amount of the throttle valve 11 opening is obtained.

As mentioned above, the accelerator 7 is not mechanically connected with the throttle valve 11 and thereby it is able to obtain a smooth start and a smooth driving of the vehicle. Now, when the operation of the accelerator 7 is released, the throttle valve 11 is fully closed by the driving force of the motor 90 and the urging force of the return spring (not shown) which is disposed in the support 4.

In the above ordinary accelerator control mode, when the abnormal conditions including an abnormal operation of the throttle valve 11 are detected, the electric current which is turned on the electromagnetic coil 20 is interrupted. Thereby, the clutch plate 40 is separated from the rotor 30 by the urging force of the sheet springs 45 and the throttle valve 11 is returned to its initial position by the return spring which is disposed in the support 4. Furthermore, the driving of the rotor 30 by the motor 90 is stopped too. In this situation, since the clutch plate 40 is moved toward the plate holder 50, the pin 42 is located between both surfaces 61*a* and 61*b* of the notch 61 of the operation plate 60. Accordingly, when the accelerator 7 is depressed more than a predetermined amount, the operation plate 60 is rotated and the surface 61*a* of the notch 61 is contacted with the pin 42. Therefore, hereafter it is able to directly transmit the operation force of the accelerator 7 by driver to the throttle shaft 12.

Next, the operation of the acceleration slip control mode is explained. When a slip of driving wheels is detected by the controller 100 at a starting time or an accelerating time in response to the output signal of the wheel speed sensor 122 shown in FIG. 7, the control mode is changed from the above described ordinary accelerator control mode to the accelerator slip control and the amount of the throttle valve 11 opening is controlled as follows.

Namely, in the controller 100, a slip ratio which can obtain a sufficient tractive force and a sufficient side reaction is calculated and furthermore a target amount of the throttle valve opening is calculated in order to maintain this slip ratio. Then, the driving of the motor 90 is controlled by the controller 100 so that the throttle valve 11 maintains the target amount of the throttle valve opening. When the slip rate becomes less than a predetermined value and the target amount of the throttle valve opening becomes more than the amount of the throttle valve opening determined in the ordinary accelerator control mode, the acceleration slip control mode ends and the control mode returns to the ordinary accelerator control mode.

In this situation, since the operation plate 60 and the pin 42 are engaged with each other in normal condition as mentioned above, even though the accelerator 7 is depressed more than the predetermined amount, a mechanically intervention is not generated in the control of the amount of the throttle valve opening by the motor 90. Accordingly, for example, when an acceleration slip is generated on road surface with low friction coefficient and the control mode changed to the acceleration slip control mode, even though the driver depresses the accelerator 7 large, it is able to fully close the throttle valve 11 by the motor 90. Therefore, it is able to perform the expected acceleration slip control and it is able to maintain the stable driving.

Now, the operation of the constant speed driving control mode is briefly explained. In the constant speed driving control mode, a target amount of the throttle valve opening is determined in response to a difference between the vehicle's speed which was detected by the wheel speed sensor 122 and a vehicle's speed which was set by a set switch (not shown) of the constant speed driving control and the driving of the motor 90 is controlled by the controller 100 so that the throttle valve 11 maintains this target amount of the throttle valve opening. When the accelerator 7 is depressed for outrunning and so on during the constant speed driving and the amount of the throttle valve opening corresponding to the operation amount in the ordinary accelerator control mode exceeds the target amount of the throttle valve opening which the constant speed driving control mode was set, the constant speed driving control mode is changed to an overlaid mode and this target amount of the throttle valve opening is replaced with the amount of the throttle valve opening which is determined in the ordinary accelerator control mode.

As described above, according to the present invention, since the adjustment of the amount of the throttle valve opening is performed by the driving source regardless of the operation of the accelerator operation mechanism in the ordinary driving, it is able to maintain the smooth starting and the smooth driving and it is able to easily perform the various controls such as the acceleration slip control, the constant speed driving control and so on. Furthermore, since it is able to maintain the predetermined amount of the throttle valve opening when the abnormality of the apparatus is detected and the throttle control of the driving source became impossible, it is able to drive the vehicle, for example, to the repair place. Additionally, since the engagement between the movable member and the operation member is released in the acceleration slip control, even though the accelerator operation mechanism is operated while the acceleration slip control performs, the throttle valve is independent of this operation and therefore it is able to perform a proper acceleration slip control.

Furthermore, according to the present invention, in the case of the throttle apparatus which the first nail portions and the second nail portions are formed on the rotor and the movable member, respectively, it is able to certainly transmit the driving force of the driving source to the throttle shaft.

Furthermore, according to the present invention, in the case of the throttle control apparatus which the engaging member is formed by the extension of the pin which fixes the sheet springs, it is able to reduce the number of the parts.

The principles, preferred embodiment of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in appended claims.

What is claimed is:

1. A throttle control apparatus comprising;

an accelerator operation mechanism, a driving source generating driving force in response to at least an operational amount of the accelerator operation mechanism, a throttle shaft fixing a throttle valve of an internal combustion engine thereto and supported on a housing so as to be able to rotate and having at least an one end portion which extends from the housing, a supporting member fixed to an extending portion of the throttle shaft, a rotor supported at a prescribed position on the throttle shaft between the supporting member and the housing so as to be able to rotate and so as not be able to move in the direction of an axis of the throttle shaft and connected with the driving source so as to be rotated by the driving force of the driving source, a movable member made of a magnetic substance and supported on the throttle shaft so as to be movable in the direction of the axis of the throttle shaft between the rotor and the supporting member, a connection member connecting the movable member with the supporting member and urging the movable member toward the supporting member, an electromagnetic coil fixed at a position of the housing opposite to the rotor and attracting the movable member under its own exciting condition so as to connect the movable member with the rotor, an engaging member having a longitudinal length, fixed to the movable member at its one end and extending its other end in the axial direction of the throttle shaft, and an operation member supported on a shaft which is disposed nearly in parallel with the axis of the throttle shaft so as to be able to rotate and having an end surface which can be engaged with the other end of the engaging member in nearly perpendicular direction with regard to the axis of the throttle shaft and connected with the accelerator operation mechanism so as to be able to rotate in response to the operation of the accelerator operation mechanism, the operation member has the end surface which is set to be engaged with the longitudinal length of the engaging member only when the movable member positions at the side of the supporting member.

2. A throttle control apparatus as recited in claim 1, wherein the rotor is provided with outer teeth which are formed on the whole circumference of its own outer circumferential end portion and first nail portions which are formed on an its own flat portion adjacent to the outer teeth so as to radially extend and so as to be continuously arranged on the whole circumference, and wherein the movable member is provided with second nail portions which are formed on the whole circumference of an its own flat portion opposite to the rotor so as to locate opposite to the first nail portion and so as to have a substantially same shape as the first nail portions in order to constitute a dog clutch with the rotor.

3. A throttle control apparatus as recited in claim 1, wherein the connection member is comprised of a sheet spring which is connected with the movable member and the supporting member at its both end, respectively and the engaging member is formed by the extension of a pin which fixes the sheet spring to the movable member.

* * * * *